US007329175B2

(12) United States Patent
Woo et al.

(10) Patent No.: US 7,329,175 B2
(45) Date of Patent: Feb. 12, 2008

(54) ABRASIVE ARTICLE AND METHODS OF MAKING SAME

(75) Inventors: Edward J. Woo, Woodbury, MN (US); Thomas W. Rambosek, Woodbury, MN (US); Curtis J. Schmidt, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/321,505

(22) Filed: Dec. 29, 2005

(65) Prior Publication Data

US 2006/0148390 A1 Jul. 6, 2006

Related U.S. Application Data

(60) Provisional application No. 60/640,397, filed on Dec. 30, 2004.

(51) Int. Cl.
*B24D 11/00* (2006.01)

(52) U.S. Cl. ..... 451/530; 451/533; 451/538

(58) Field of Classification Search ..... 451/526–528, 451/530, 533, 534, 538, 539, 548–552; 51/293, 51/298, 307–309
See application file for complete search history.

(56) References Cited

U.S. PATENT DOCUMENTS

| | | | | |
|---|---|---|---|---|
| 1,850,413 A | | 3/1932 | Porte | |
| 1,862,103 A | | 6/1932 | Stratford | |
| 1,961,911 A | | 6/1934 | Pusch | |
| 2,123,581 A | | 7/1938 | Anderson | |
| 2,740,239 A | | 4/1956 | Ball et al. | |
| 2,749,681 A | | 6/1956 | Reidenbach | |
| 2,838,890 A | | 6/1958 | McIntyre | |
| 2,984,052 A | | 5/1961 | Mueller, Jr. | |
| 3,021,649 A | | 2/1962 | Robbins | |
| 3,353,308 A | | 11/1967 | Zane | |
| 3,420,007 A | * | 1/1969 | Kolesh | 451/548 |
| 3,861,892 A | | 1/1975 | Wisdom, Jr. et al. | |
| 3,932,966 A | | 1/1976 | Stern | |
| 4,001,366 A | | 1/1977 | Brumlik | |
| 4,062,152 A | | 12/1977 | Mehrer | |
| 4,158,935 A | | 6/1979 | Robert | |
| 4,282,011 A | * | 8/1981 | Terpay | 51/298 |
| 4,287,685 A | | 9/1981 | Marton | |
| 4,437,269 A | | 3/1984 | Shaw | |
| 4,590,113 A | | 5/1986 | Herzog | |

(Continued)

FOREIGN PATENT DOCUMENTS

DE 34 16 186 A1 1/1985

(Continued)

OTHER PUBLICATIONS

U.S. Appl. No. 11/229,277, filed Sep. 16, 2005, Woo et al.

(Continued)

*Primary Examiner*—Dung Van Nguyen

(57) ABSTRACT

A porous abrasive article that allows air and dust particles to pass through. The abrasive article has a screen abrasive and a porous attachment interface. The screen abrasive has an abrasive layer comprising a plurality of erectly oriented abrasive particles and at least one binder. The porous attachment interface cooperates with the screen abrasive to allow the flow of particles through the abrasive article.

20 Claims, 4 Drawing Sheets

U.S. PATENT DOCUMENTS 4,609,581 A 9/1986 Ott
4,631,220 A 12/1986 Clifton
4,645,699 A 2/1987 Neveu
4,722,203 A 2/1988 Darjee
4,725,487 A 2/1988 Pemrick et al.
4,759,155 A 7/1988 Shaw
4,844,967 A 7/1989 Goralski et al.
4,920,702 A 5/1990 Kloss et al.
4,932,163 A 6/1990 Chilton et al.
4,937,984 A 7/1990 Taranto
4,964,243 A 10/1990 Reiter
4,964,245 A 10/1990 Braasch
5,007,206 A 4/1991 Paterson
5,036,627 A 8/1991 Walters
5,131,924 A * 7/1992 Wiand ..... 51/293
5,254,194 A 10/1993 Ott et al.
5,256,231 A 10/1993 Gorman et al.
5,317,886 A 6/1994 Prahl
5,354,591 A 10/1994 Ott et al.
5,367,839 A 11/1994 Pearce
5,389,032 A 2/1995 Beardsley
5,458,532 A 10/1995 Cannone
5,490,878 A 2/1996 Peterson et al.
5,505,747 A 4/1996 Chesley et al.
5,533,923 A 7/1996 Shamouilian et al.
5,560,794 A 10/1996 Currie et al.
5,578,343 A 11/1996 Gaeta et al.
5,607,345 A 3/1997 Barry et al.
5,616,394 A 4/1997 Gorman et al.
5,667,540 A 9/1997 Chesley et al.
5,674,122 A 10/1997 Krech
5,695,533 A 12/1997 Kardys et al.
5,807,161 A 9/1998 Manor et al.
5,810,650 A 9/1998 Jöst
5,891,549 A 4/1999 Beretta et al.
5,904,793 A 5/1999 Gorman et al.
5,954,844 A 9/1999 Law et al.
5,989,112 A 11/1999 Long et al.
6,024,634 A 2/2000 Höglund et al.
6,059,644 A 5/2000 Manor et al.
6,074,292 A 6/2000 Gilday
6,077,156 A 6/2000 Amin et al.
6,077,601 A 6/2000 DeVoe et al.
6,190,246 B1 2/2001 Parrott et al.
6,197,076 B1 3/2001 Braunschweig et al.
6,280,824 B1 8/2001 Insley et al.
6,312,325 B1 11/2001 Van Osenbruggen
6,368,199 B1 4/2002 Van Osenbruggen
6,482,308 B1 11/2002 Wiemann
6,575,821 B2 6/2003 Jöst
6,579,162 B2 6/2003 Chesley et al.
6,613,113 B2 9/2003 Minick et al.
6,790,126 B2 9/2004 Wood et al.
6,923,840 B2 8/2005 Schutz et al.
2001/0044006 A1 11/2001 Kruegler
2003/0003856 A1 1/2003 Swei
2003/0127108 A1 7/2003 Policicchio et al.
2003/0143938 A1 7/2003 Braunschweig et al.
2003/0159363 A1 8/2003 Chesley et al.
2004/0098923 A1 5/2004 Hood et al.
2004/0109978 A1 6/2004 Michel
2004/0148866 A1 8/2004 Krupnick
2004/0166788 A1 8/2004 Travis
2004/0170801 A1 9/2004 Seth et al.
2004/0170802 A1 9/2004 Seth et al.
2004/0209561 A1 10/2004 Suzuki et al.
2005/0124274 A1 6/2005 Hoglund
2006/0019579 A1 1/2006 Braunschweig
2007/0028525 A1 2/2007 Woo et al. ..... 51/298

FOREIGN PATENT DOCUMENTS

DE 41 24 520 A1 1/1993
DE 201 11 245 U 1 8/2001
EP 0 244 934 11/1967
EP 0 064 748 8/1984
EP 0 166 060 9/1988
EP 0 285 042 A1 10/1988
EP 0 578 865 A1 1/1994
EP 0 738 562 10/1996
EP 1 488 888 A1 12/2004
EP 1 524 077 A1 4/2005
EP 1 733 844 A1 12/2006
FR 2 659 892 9/1991
FR 2 739 308 4/1997
GB 1137556 12/1968
GB 1539477 1/1970
GB 2 017 485 A 10/1979
GB 2 057 483 A 4/1981
GB 2 162 213 A 1/1986
GB 2 199 053 A 6/1988
JP 5-220670 8/1993
JP 11-179668 7/1999
WO WO90/14039 11/1990
WO WO96/07509 3/1996
WO WO 00/64634 11/2000
WO WO 03/020474 A1 3/2003

OTHER PUBLICATIONS

U.S. Appl. No. 11/198,265, filed Aug. 5, 2005, Woo et al.
U.S. Appl. No. 11/197,798, filed Aug. 5, 2005, Woo et al.
U.S. Appl. No. 11/228,896, filed Sep. 16, 2005, Rambosek et al.
U.S. Appl. No. 11/229,281, filed Sep. 16, 2005, Woo et al.
U.S. Appl. No. 29/238,541, filed Sep. 16, 2005, Braunschweig et al.
U.S. Appl. No. 29/238,542, filed Sep. 16, 2005, Braunschweig et al.
U.S. Appl. No. 29/238,556, filed Sep. 16, 2005, Braunschweig et al.
U.S. Appl. No. 29/246,256, filed Mar. 28, 2006, Shimizu et al.
U.S. Appl. No. 29/246,257, filed Mar. 28, 2006, Shimizu et al.
U.S. Appl. No. 29/246,258, filed Mar. 28, 2006, Shimizu et al.
U.S. Appl. No. 29/246,259, filed Mar. 28, 2006, Shimizu et al.
U.S. Appl. No. 29/246,260, filed Mar. 28, 2006, Shimizu et al.
U.S. Appl. No. 29/246,261, filed Mar. 28, 2006, Shimizu et al.
U.S. Appl. No. 29/253,148, filed Feb. 1, 2006, Braunschweig et al.
U.S. Appl. No. 29/253,110, filed Feb. 1, 2006, Braunschweig et al.
U.S. Appl. No. 29/253,085, filed Feb. 1, 2006, Braunschweig et al.
U.S. Appl. No. 29/253,084, filed Feb. 1, 2006, Braunschweig et al.
"robAust", Roberlo Abrasives,Copyright © 2002-2006 robAust Pty Ltd., [retrieved from the internet on Jul. 6, 2006], URL <http://www.robaust.com/shopdisplayproducts.asp?id=30&cat=Roberlo+Abrasives>, pp. 2.
"List of Products", Roberlo United States, © Copyright 2003 Roberloroberlousa.com, roberlo.com), [retrieved from the internet on Jan. 7, 2004 ], URL <http://www.roberlousa.com/abrasives.htm>, pp. 2.

* cited by examiner

ABRASIVE ARTICLE AND METHODS OF MAKING SAME

CROSS REFERENCE TO RELATED APPLICATIONS

This application claims the benefit of U.S. Provisional Patent Application No. 60/640,397, filed Dec. 30, 2004, incorporated herein by reference.

FIELD OF THE INVENTION

The present invention relates generally to an abrasive article and, more particularly, to a porous abrasive article that allows air and dust particles to pass through.

BACKGROUND

Abrasive articles are used in industry for abrading, grinding, and polishing applications. They can be obtained in a variety of converted forms, such as belts, discs, sheets, and the like, in many different sizes.

Generally, when using abrasives articles in the form of "sheet goods" (i.e., discs and sheets), a back-up pad is used to mount or attach the abrasive article to the abrading tool. One method of attaching abrasive discs and sheets to back-up pads includes a two-part mechanical engagement system, such as, for example, a hook and loop fastener. When the attachment means is a hook and loop system, the abrasive article will have either a loop or the hook component on the backing surface opposite the abrasive coating, and the back-up pad will have the complementary mating component (i.e., a hook or loop).

One type of back-up pad has dust collection holes connected by a series of grooves to help control swarf build-up on the abrading surface of the abrasive article. The dust collection holes are typically connected to a vacuum source. The dust collection grooves and holes provide a passageway for removing particles such as swarf, dust, and debris from the abrading surface. The passageway can also be used to remove abrading fluids, such as water or oil, from the abrading surface.

In some configurations, particles and fluid pass from the abrading surface of the abrasive article to the back-up pad through holes cut in the abrasive article. The dust extraction capabilities of these designs are limited because of the intermittent presence of the holes. In other configurations, the abrasive article is made from a porous knitted cloth with integral loops, such as reported by Hoglund et al. in U.S. Pat. No. 6,024,634.

The performance of the abrasive article reported by Hoglund et al. is limited, at least in part, by the capabilities of the knitting equipment used to manufacture the knitted cloth for the abrasive article as well as the capabilities of the abrasive coating processes used to apply the abrasive layer to selected regions of the knitted cloth.

There is a continuing need for alternative ways to provide a cost effective abrasive article with a mechanical fastening system and dust extraction capabilities. It would be particularly desirable to provide a porous abrasive article in which the abrasive layer could be designed and manufactured independently of the attachment means.

SUMMARY

The present invention relates generally to an abrasive article and, more particularly, to a porous abrasive article that allows air and dust particles to pass through.

In one aspect, the present invention provides an abrasive article comprising a screen abrasive and a porous attachment interface. The screen abrasive comprises an open mesh backing having a first major surface, a second major surface, and a plurality of openings extending from the first major surface to the second major surface. An abrasive layer comprising a plurality of erectly oriented abrasive particles and at least one binder is secured to at least a portion of the first major surface of the backing. The porous attachment interface comprises a loop portion of a two-part mechanical engagement system and cooperates with the screen abrasive to allow the flow of particles through the abrasive article.

In some embodiments, the open mesh backing a woven. In some embodiments, the open mesh backing can comprises fiberglass, nylon, polyester, polypropylene, or aluminum. In other embodiments, the open mesh backing is a perforated film.

In some embodiments, the openings in the open mesh backing have an average open area of at least 0.3 square millimeters. In some embodiments, the openings have a total open area of at least 50 percent of the area of the first major surface.

In some embodiments, the porous attachment interface comprises a nonwoven. In some embodiments, the porous attachment interface comprises a nonwoven having a Gurley porosity no greater than 3 seconds per 300 cubic centimeters of air. In some embodiments, the abrasive article has a Gurley porosity no greater than 3 seconds per 300 cubic centimeters of air.

In some embodiments, adhesive (e.g., hot-melt or spray) is used to secure the porous attachment interface to the open mesh backing.

In another aspect, the present invention provides methods for making abrasive articles having a screen abrasive and a porous attachment interface that cooperates with the screen abrasive to allow the flow of particles through the abrasive article.

In another aspect, the present invention provides alternative ways to provide a cost effective abrasive article with a mechanical fastening system and dust extraction capabilities. The abrasive article is useful for abrading a variety of surfaces, including, for example, paint, primer, wood, plastic, fiberglass, and metal. In some embodiments, the abrasive layer can be designed and manufactured independently of the porous attachment interface, allowing the manufacturer to optimize the performance of the screen abrasive substantially independently of the selection of porous attachment interface, and vice versa.

The above summary of the present invention is not intended to describe each disclosed embodiment or every implementation of the present invention. The Figures and the detailed description that follow more particularly exemplify illustrative embodiments.

In the context of the present invention:

"erectly oriented" refers to a characteristic in which the longer dimensions of a majority of the abrasive particles are oriented substantially perpendicular (i.e., between 60 and 120 degrees) to the backing.

DETAILED DESCRIPTION

Figure 1:
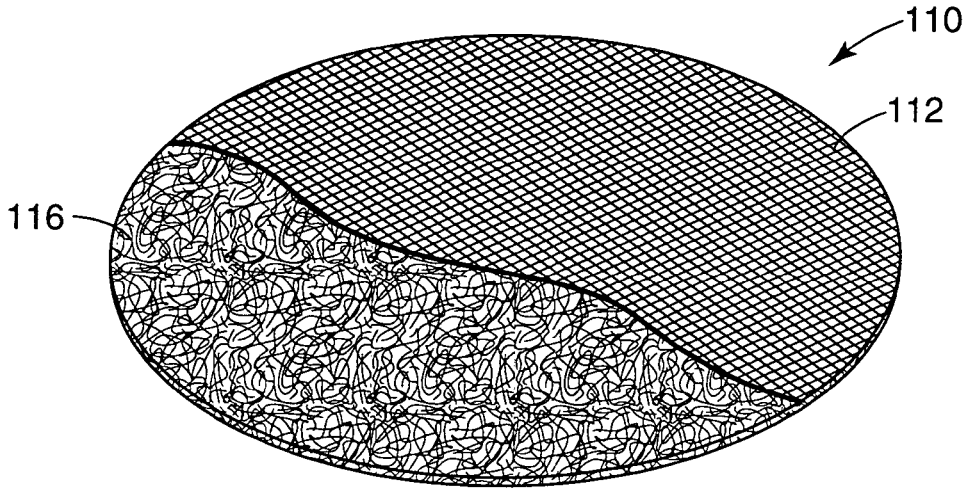
FIG. 1 is a perspective view of an exemplary abrasive article according to the present invention partially cut away to reveal the porous attachment interface.

FIG. 1 shows a perspective view of an exemplary abrasive article 110 with a partial cut away. As shown in FIG. 1, the abrasive article 110 has a screen abrasive 112 on its upper surface and a porous attachment interface 116 attached to the screen abrasive 112. The porous attachment interface 116 cooperates with the screen abrasive 112 to allow the flow of particles through the abrasive article 110.

The porous attachment interface forms the loop portion of a two-part mechanical engagement system. The porous attachment interface is typically used to affix the abrasive article of the present invention to a back-up pad. The back-up pad typically includes a generally planar major surface with hooks to which the porous attachment interface of the abrasive article, such as a disc or sheet, may be attached.

Although back-up pads may be hand held, back-up pads are more commonly used in conjunction with a powered abrading apparatus such as electric or pneumatic sanders. The porous attachment interface can be designed with loops that permit the abrasive article to be removed from a back-up pad with a small amount of force. The loops can also be designed to resist movement of the abrasive article relative to the back-up pad during use. The desired loop dimensions will depend upon the shape and type of hooking stems provided and on the desired engagement characteristics of the abrasive article.

Suitable materials for the porous attachment interface include both woven and nonwoven materials. In woven and knit porous attachment interface materials, loop-forming filaments or yams are included in the structure of a fabric to form upstanding loops for engaging hooks. In nonwoven attachment interface materials, the loops can be formed by the interlocking fibers. In some nonwoven attachment interface materials, the loops are formed by stitching a yam through the nonwoven web to form upstanding loops.

Useful nonwovens suitable for use as a porous attachment interface include, but are not limited to, airlaids, spunbonds, spunlaces, bonded melt blown webs, and bonded carded webs. The nonwoven materials can be bonded in a variety of ways known to those skilled in the art, including, for example, needle-punched, stichbonded, hyrdoentangled, chemical bond, and thermal bond. The woven or nonwoven materials used can be made from natural (e.g., wood or cotton fibers), synthetic fibers (e.g., polyester or polypropylene fibers) or combinations of natural and synthetic fibers. In some embodiments, the porous attachment interface is made from nylon, polyester or polypropylene.

In some embodiments, the porous attachment interface has an open structure that does not significantly interfere with the flow of air or particles through it. In some embodiments, the porous attachment interface material is selected, at least in part, based on the porosity of the material.

Porosity for the porous attachment interface of the present invention is measured with a Gurley Densitometer Model 4410. The Gurley Densitometer measures the amount of time, in seconds, required for 300 cubic centimeters of air to pass through a 0.65 square centimeter area of the porous attachment interface using a 1.39 Joules per meter force. The Gurley apparatus and procedures for its use are known in the textile industry. For purposes of the present invention, a material or composite shall be considered "porous" if it has a Gurley porosity that is less than 5 seconds per 300 cubic centimeters of air.

In some embodiments, the porous attachment interface has a Gurley porosity that is no greater than 3 seconds per 300 cubic centimeters of air. In other embodiments, the porous attachment interface has a Gurley porosity that is no greater than 1 second per 300 cubic centimeters of air. In yet further embodiments, the porous attachment interface has a Gurley porosity that is no greater than 0.5 seconds per 300 cubic centimeters of air.

In addition to measuring the Gurley porosity of the materials used in the construction of an abrasive article of the present invention (e.g., the porous attachment interface), the Gurley porosity of the abrasive article can be measured. In some embodiments, the abrasive article of the present invention has a Gurley porosity that is no greater than 5 seconds per 300 cubic centimeters of air. In other embodiments, the abrasive article of the present invention has a Gurley porosity that is no greater than 1.5 seconds per 300 cubic centimeters of air. In yet further embodiments, the abrasive article has a Gurley porosity that is no greater than 1 second per 300 cubic centimeters of air.

The porous attachment interface, whether woven or nonwoven, may be made in a wide variety basis weights. Porous attachment interfaces useful in the present invention typically have an average basis weight of at least about 30 grams per square meter. In some embodiments, the porous attachment interface has an average basis weight of at least about 40 grams per square meter. In yet further embodiments, the porous attachment interface has an average basis weight of at least about 50 grams per square meter.

Porous attachment interfaces useful in the present invention typically have an average basis weight that is not greater than about 100 grams per square meter. In some embodiments, the porous attachment interface has an average basis weight that is not greater than about 90 grams per square meter. In yet further embodiments, the porous attachment interface has an average basis weight that is not greater than about 85 grams per square meter.

The porous attachment interface, whether woven or nonwoven, may be made in a wide variety thicknesses. For purposes of the present invention, the thickness of the porous attachment interface is determined using a 10 gram circular platen having an area of 10 square centimeters. Porous attachment interface thicknesses useful in the present invention typically have an average thickness that is less than about 3 millimeters. In some embodiments, the porous attachment interface has an average thickness that is less than about 1.5 millimeter. In yet further embodiments, the porous attachment interface has an average thickness that is less than about 1 millimeter.

Porous attachment interface thicknesses useful in the present invention typically have an average thickness that is at least about 0.2 millimeter. In some embodiments, the porous attachment interface has an average thickness that is at least about 1 millimeter. In yet further embodiments, the porous attachment interface has an average thickness that is at least about 1.5 millimeter.

Figure 2:
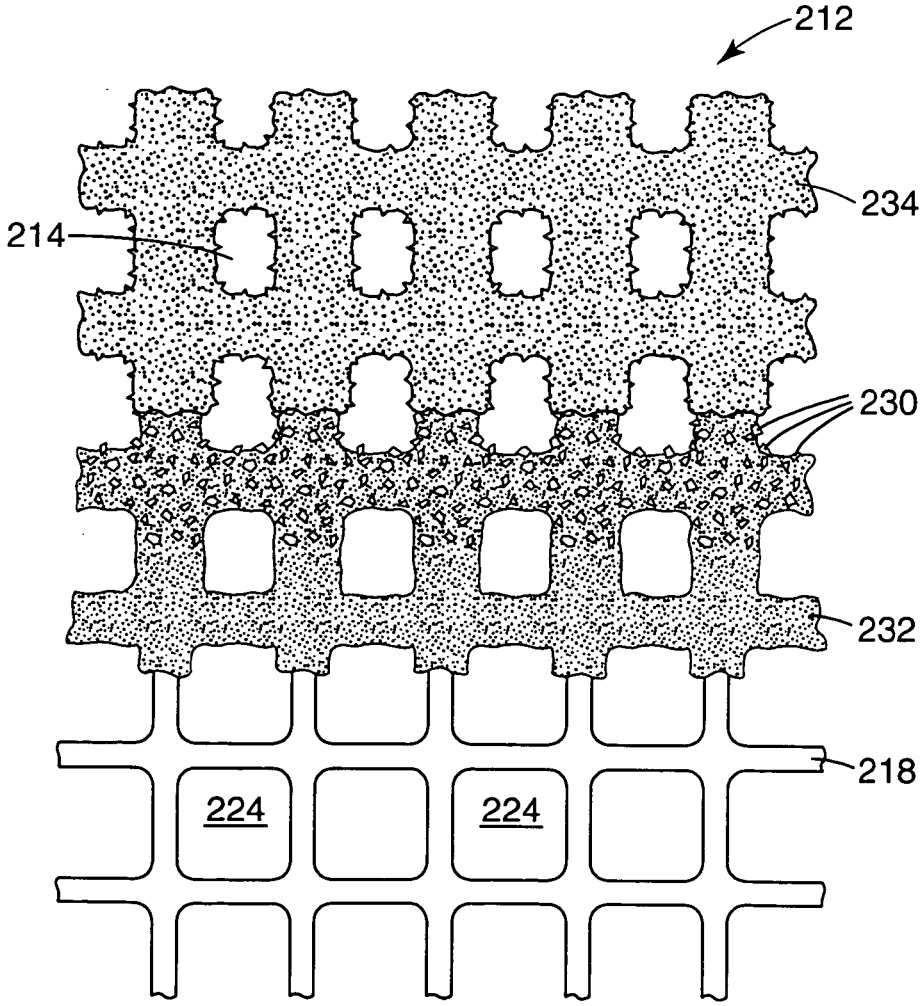
FIG. 2 is a perspective view of an exemplary open mesh screen abrasive partially cut away to reveal the components of the abrasive layer.

FIG. 2 is a perspective view of an exemplary open mesh screen abrasive 212 partially cut away to reveal the components of the abrasive layer. The screen abrasive 212 comprises an open mesh backing 218 covered with an abrasive layer. The open mesh backing 218 has a plurality of openings 224. The abrasive layer comprises a make coat 232, abrasive particles 230, and a size coat 234. A plurality of openings 214 extend through the screen abrasive 212.

The open mesh backing can be made from any porous material, including, for example, perforated films or woven or knitted fabrics. In the embodiment shown in FIG. 2, the open mesh backing 218 is a perforated film. The film for the backing can be made from metal, paper, or plastic, including molded thermoplastic materials and molded thermoset materials. In some embodiments, the open mesh backing is made from perforated or slit and stretched sheet materials. In some embodiments, the open mesh backing is made from fiberglass, nylon, polyester, polypropylene, or aluminum.

The openings 224 in the open mesh backing 218 can be generally square shaped as shown in FIG. 2. In other embodiments, the shape of the openings can be other geometric shapes, including, for example, a rectangle shape, a circle shape, an oval shape, a triangle shape, a parallelogram shape, a polygon shape, or a combination of these shapes. The openings 224 in the open mesh backing 218 can be uniformly sized and positioned as shown in FIG. 2. In other embodiments, the openings made be placed non-uniformly by, for example, using a random opening placement pattern, varying the size or shape of the openings, or any combination of random placement, random shapes, and random sizes. In some embodiments, the vacuum port configuration of the back-up pad is considered when selecting the shape, size, and placement of the openings in the open mesh backing.

Figure 3:
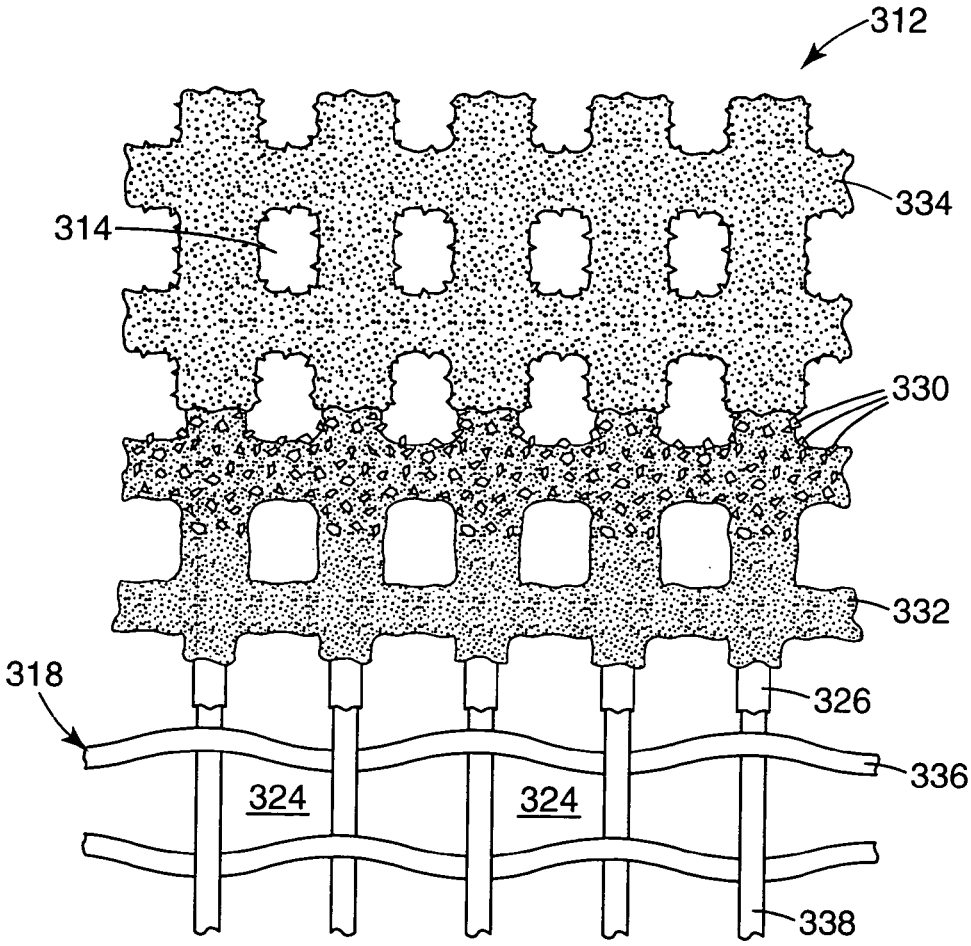
FIG. 3 is a perspective view of an exemplary woven open mesh screen abrasive partially cut away to reveal the components of the abrasive layer.

FIG. 3 is a perspective view of an exemplary woven open mesh screen abrasive partially cut away to reveal the components of the abrasive layer. As shown in FIG. 3, the screen abrasive 312 comprises a woven open mesh backing 318 and an abrasive layer. The abrasive layer comprises a make coat 332, abrasive particles 330, and a size coat 334. A plurality of openings 314 extend through the screen abrasive 312.

The woven open mesh backing 318 comprises a plurality of generally parallel warp elements 338 that extend in a first direction and a plurality of generally parallel weft elements 336 that extend in a second direction. The weft 338 and warp elements 336 of the open mesh backing 318 form a plurality of openings 324. An optional lock layer 326 can be used to improve integrity of the open mesh backing or improve adhesion of the abrasive layer to the open mesh backing.

As shown in FIG. 3, the second direction is perpendicular to the first direction to form square shaped openings 324 in the woven open mesh backing 318. In some embodiments, the first and second directions intersect to form a diamond pattern. The shape of the openings can be other geometric shapes, including, for example, a rectangle shape, a circle shape, an oval shape, a triangle shape, a parallelogram shape, a polygon shape, or a combination of these shapes. In some embodiments, the warp and weft elements are yams that are woven together in a one-over-one weave.

The warp and weft elements may be combined in any manner known to those in the art, including, for example, weaving, stitch-bonding, or adhesive bonding. The warp and weft elements may be fibers, filaments, threads, yams or a combination thereof. The warp and weft elements may be made from a variety of materials known to those skilled in the art, including, for example, synthetic fibers, natural fibers, glass fibers, and metal. In some embodiments, the warp and weft elements comprise monofilaments of thermoplastic material or metal wire. In some embodiments, the woven open mesh backing comprises nylon, polyester, or polypropylene.

The openings 324 in the open mesh backing 318 can be uniformly sized and positioned as shown in FIG. 3. In other embodiments, the openings can be placed non-uniformly by, for example, using a random opening placement pattern, varying the size or shape of the openings, or any combination of random placement, random shapes, and random sizes.

The open mesh backing, whether woven or perforated, may comprise openings having different open areas. The "open area" of an opening in the mesh backing refers to the area of the opening as measured over the thickness of the mesh backing (i.e., the area bounded by the perimeter of material forming the opening through which a three-dimensional object could pass). Open mesh backings useful in the present invention typically have an average open area of at least about 0.3 square millimeters per opening. In some embodiments, the open mesh backing has an average open area of at least about 0.5 square millimeters per opening. In yet further embodiments, the open mesh backing has an average open area of at least about 0.75 square millimeters per opening.

Typically, open mesh backings useful in the present invention have an average open area that is less than about 3.5 square millimeters per opening. In some embodiments, the open mesh backing has an average open area that is less than about 2.5 square millimeters per opening. In yet further embodiments, the open mesh backing has an average open area that is less than about 0.95 square millimeters per opening.

The open mesh backing, whether woven or perforated, comprise a total open area that affects the amount of air that can pass through the open mesh backing as well as the effective area and performance of the abrasive layer. The "total open area" of the mesh backing refers to the cumulative open areas of the openings as measured over a unit area of the mesh backing. Open mesh backings useful in the present invention have a total open area of at least about 0.5 square centimeters per square centimeter of backing (i.e., 50% open area). In some embodiments, the open mesh backing has a total open area of at least about 0.6 square centimeters per square centimeter of backing (i.e., 60% open area). In yet further embodiments, the open mesh backing has a total open area of at least about 0.75 square centimeters per square centimeter of backing (i.e., 75% open area).

Typically, open mesh backings useful in the present invention have a total open area that is less than about 0.95 square centimeters per square centimeter of backing (i.e., 95% open area). In some embodiments, the open mesh backing has a total open area that is less than about 0.9 square centimeters per square centimeter of backing (i.e., 90% open area). In yet further embodiments, the open mesh backing has a total open area that is less than about 0.82 square centimeters per square centimeter of backing (i.e., 82% open area).

As discussed above, the abrasive layer of the screen abrasive comprises a plurality of abrasive particles and at least one binder. In some embodiments, the abrasive layer comprises a make coat, a size coat, a supersize coat, or a combination thereof. In some embodiments, a treatment can be applied to the open mesh backing such as, for example, a presize, a backsize, a subsize, or a saturant.

Typically, the make layer of a coated abrasive is prepared by coating at least a portion of the open mesh backing (treated or untreated) with a make layer precursor. Abrasive particles are then at least partially embedded (e.g., by electrostatic coating) to the make layer precursor comprising a first binder precursor, and the make layer precursor is at least partially cured. Electrostatic coating of the abrasive particles typically provides erectly oriented abrasive particles. Other techniques for erectly orienting abrasive particles can also be used.

Figure 5:
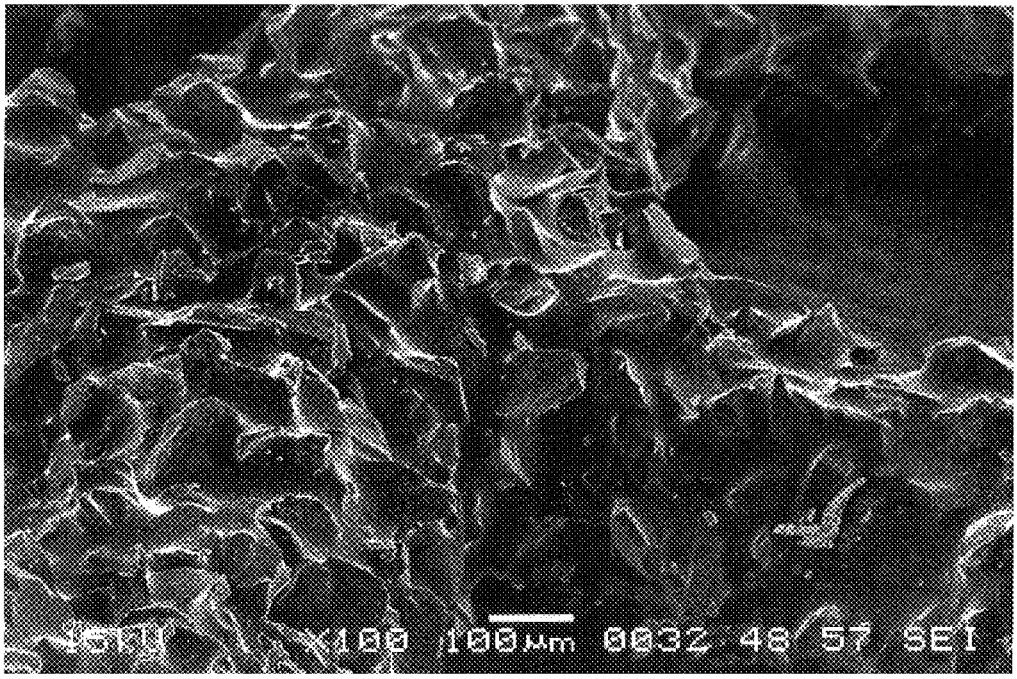
FIG. 5 is a SEM photomicrograph at 100 times of an abrasive surface of a screen abrasive article with abrasive particles that are not erectly oriented.
Figure 6:
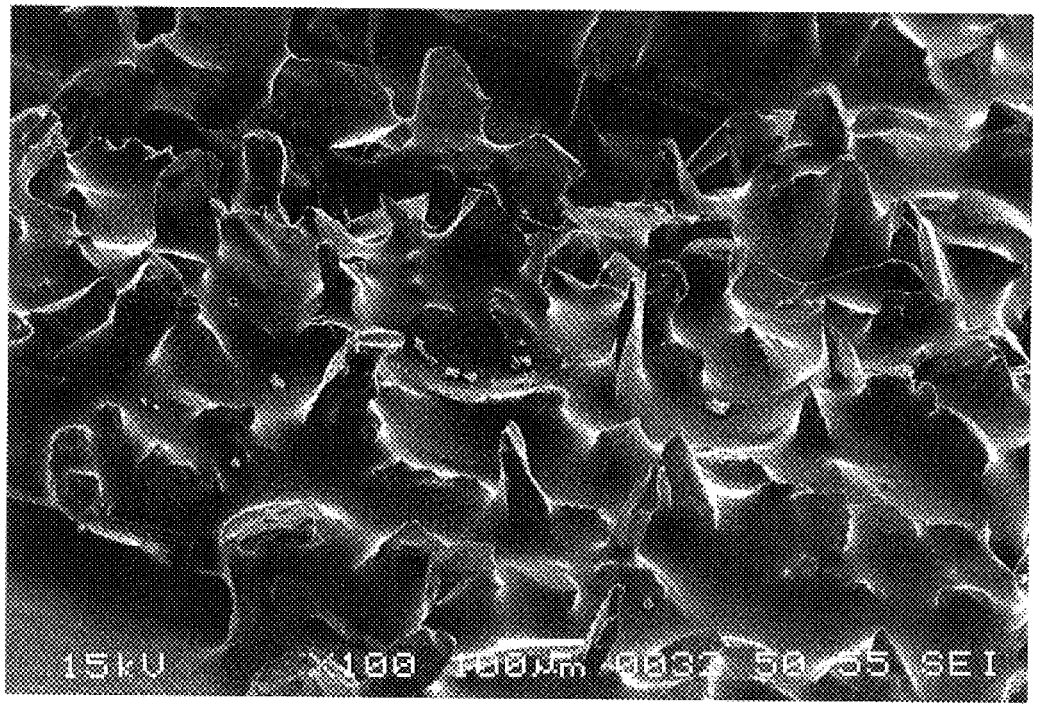
FIG. 6 is a SEM photomicrograph at 100 times of an abrasive surface of a screen abrasive of the present invention having erectly oriented abrasive particles.

FIG. 6 is a SEM photomicrograph at 100 times of an abrasive surface of a screen abrasive of the present invention having erectly oriented abrasive particles. FIG. 5 is a SEM photomicrograph at 100 times of an abrasive surface of a screen abrasive article with abrasive particles that are not erectly oriented.

Next, the size layer is prepared by coating at least a portion of the make layer and abrasive particles with a size layer precursor comprising a second binder precursor (which may be the same as, or different from, the first binder precursor), and at least partially curing the size layer precursor. In some coated abrasive articles, a supersize is applied to at least a portion of the size layer. If present, the supersize layer typically includes grinding aids and/or anti-loading materials.

Typically, a binder is formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, urethane resings, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Suitable abrasive particles for the screen abrasive that can be used in the abrasive article of the present invention can be any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Coated screen abrasives can further comprise optional additives, such as, abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired. Additives may also be incorporated into the binder, applied as a separate coating, held within the pores of the agglomerate, or combinations of the above.

Coated screen abrasive articles may be converted, for example, into belts, rolls, discs (including perforated discs), and/or sheets. One form of a coated screen abrasive useful in finishing operations is a disc. Abrasive discs are often used for the maintenance and repair of automotive bodies and wood finishing. The discs can be configured for use with a variety of tools, including, for example, electric or air grinders. The tool used to support the disc can have a self-contained vacuum system or can be connected to a vacuum line to help contain dust.

Figure 4:
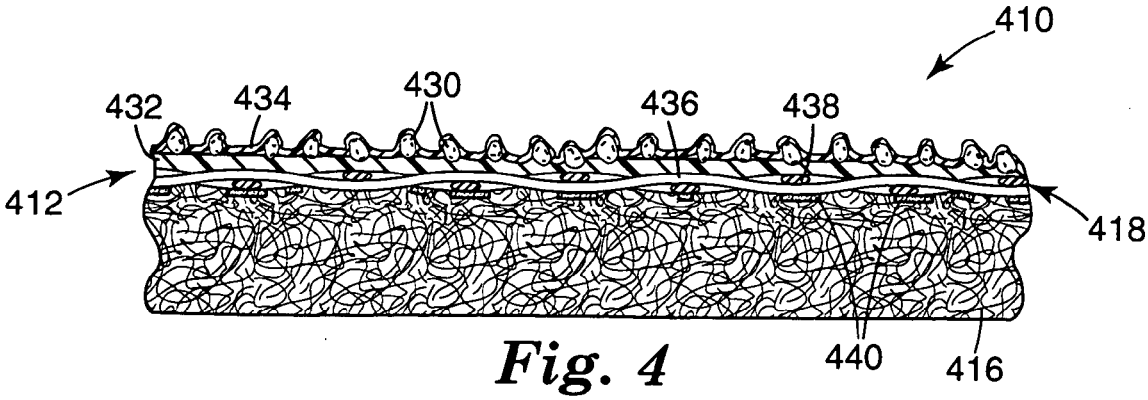
FIG. 4 is a cross-sectional view of an exemplary abrasive article according to the present invention.

FIG. 4 is a cross-sectional view of an exemplary abrasive article 410 according to the present invention. As shown in FIG. 4, the abrasive article 410 comprises a screen abrasive 412 affixed to a porous attachment interface 416 using adhesive 440. The screen abrasive 412 may be adhered to the porous attachment interface 416 using any suitable form of attachment, such as, for example, glue, pressure sensitive adhesive, hot-melt adhesive, spray adhesive, thermal bonding, and ultrasonic bonding. As shown in FIG. 4, the screen abrasive 412 comprises a woven onen mesh backing 418 and an abrasive layer. The abrasive layer comprises a make coat 432, abrasive particles 430, and a size coat 434. The woven open mesh backing 418 comprises a plurality of generally parallel warp elements 438 that extend in a first direction and a plurality of generally parallel weft elements 436 that extend in a second direction.

The screen abrasive is affixed to the porous attachment interface in a manner that does not prevent the flow of particles through the abrasive article. In some embodiments, the screen abrasive is adhered to the porous attachment interface in a manner that does not inhibit the flow of particles through the abrasive article. The level of particle flow through the abrasive article can be restricted, at least in part, by the introduction of an adhesive between the screen abrasive and the porous attachment interface. The level of restriction can be minimized by applying the adhesive to the screen abrasive in a discontinuous fashion such as, for example, as discrete adhesive areas (e.g., atomized spray or starved extrusion die) or distinct adhesive lines (e.g., hot melt swirl-spray or patterned roll coater).

In some embodiments, the particles of swarf, dust, or debris that can flow through the abrasive article of the present invention have a particle size of at least 10 micrometers. In some embodiments, at least 30 micrometer particles can pass through the abrasive article. In yet further embodiments, at least 45 micrometer particles can pass through the abrasive article.

In some embodiments, the screen abrasive is adhered to the porous attachment interface by applying a spray adhesive, such as, for example, "3M BRAND SUPER 77 ADHESIVE", available from 3M Company, St. Paul, Minn., to one side of the screen abrasive. In other embodiments, a hot-melt adhesive is applied to one side of the screen abrasive using either a hot-melt spray gun or an extruder with a comb-type shim. In yet further embodiments, a preformed adhesive porous mesh is placed between the screen abrasive and the porous attachment interface.

Adhesives useful in the present invention include both pressure sensitive and non-pressure sensitive adhesives. Pressure sensitive adhesives are normally tacky at room temperature and can be adhered to a surface by application of, at most, light finger pressure, while non-pressure sensitive adhesives include solvent, heat, or radiation activated adhesive systems. Examples of adhesives useful in the present invention include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; polyalphaolefins; amorphous polyolefins; silicone; ethylene-containing copolymers such as ethylene vinyl acetate, ethylacrylate, and ethylmethacrylate; polyurethanes; polyamides; polyesters; epoxies; polyvinylpyrrolidone and vinylpyrrolidone copolymers; and mixtures of the above. Additionally, the adhesives can contain additives such as tackifiers, plasticizers, fillers, antioxidants, stabilizers, pigments, diffusing particles, curatives, and solvents.

Advantages and other embodiments of this invention are further illustrated by the following examples, but the particular materials and amounts thereof recited in these examples, as well as other conditions and details, should not be construed to unduly limit this invention. For example, the basis weight, thickness, and composition of the porous attachment interface can vary. All parts and percentages are by weight unless otherwise indicated.

Unless otherwise noted, all parts, percentages, and ratios reported in the following examples are on a weight basis, and all reagents used in the examples were obtained, or are available, from general chemical suppliers such as the Sigma-Aldrich Chemical Company, Saint Louis, Mo., or may be synthesized by conventional techniques.

EXAMPLES

Sanding Test #1

A 5 inch (12.7 centimeters) test disc was attached to a 5 inch (12.7 centimeters) foam interface pad, available under the trade designation "HOOKIT II SOFT INTERFACE PAD" from 3M Company, St. Paul, Minn., then attached to a 5-hole, 5 inch (12.7 centimeters) by 1.25 inch (3.18 centimeters) thick vinyl faced foam back up pad, available under the trade designation "3M HOOKIT II BACKUP PAD" from 3M Company. The back up pad was mounted on a fine finishing orbital sander from National Detroit, Inc., Rockford, Ill.

The abrasive layer was manually brought into contact with a primer coated panel workpiece, 14 inches×15 inches (35.6 centimeters×38.1 centimeters). The workpiece was then abraded at 3 inches per second (7.6 centimeters per second) for 45 seconds at 66 pounds per square inch (455 kilopascals) and an angle of 10 degrees to the surface of the workpiece. The 45 second abrading cycle was repeated another 4 times, with the amount of material cut after the first, second-fourth, and fifth cycles recorded, from which the total average cut per sample was determined. The average cut rate is determined from an average of three samples. The cut-life is the ratio of final (fifth cycle) cut to initial (first cycle) cut.

Sanding Test #2

A 5 inch (12.7 centimeters) test disc was attached to a 5-hole Hookit V-channel, 5 inch (15.2 centimeters) by 1.25 inch (3.18 centimeters) thick vinyl faced foam back up pad, available under the trade designation "3M HOOKIT BACKUP PAD" (Part Number 84226) from 3M Company. The back up pad was mounted on a fine finishing dual-action orbital sander, available under the trade designation "MODEL 21038" from Dynabrade Corporation, Lawrence, N.Y. A dust collection bag with a five micrometer filter was attached to the sander to collect dust.

The abrasive layer was manually brought into contact with a gel coated test panel, 18 inches by 30 inches (45.7 centimeters by 76.2 centimeters). The sander was run at 90 pounds per square inch (620.5 kilopascals) air line pressure and a down force of 0.53 pounds per square inch (3.65 kilopascals) for 60 seconds. An angle of zero degrees to the surface of the workpiece was used. The 60 second abrading cycle is repeated another 2 times, for a total of 3.0 minutes, from which the total average cut per sample was determined. The average cut rate is determined from an average of three samples.

Sanding Test #3

A 5 inch (12.7 centimeters) test disc was attached to a 5-hole, 5 inch (12.7 centimeters) by 1.25 inch (3.18 centimeters) thick foam V-channel back up pad, available under the trade designation "3M HOOKIT BACKUP PAD" (Part Number 84226) from 3M Company. The back up pad was mounted on a fine finishing dual-action orbital sander under the trade designation "MODEL 21038" from Dynabrade Corporation. A dust collection bag with a five micrometer filter was attached to the sander to collect dust.

The abrasive layer was manually brought into contact with a coated test panel, 18 inches by 24 inches (45.7 centimeters by 61.0 centimeters). The sander was run at 90 pounds per square inch (620.5 kilopascals) air line pressure and a down force of 0.53 pounds per square inch (3.65 kilopascals) for 51 seconds. An angle of zero degrees to the surface of the workpiece was used. The 51 second abrading cycle is repeated another 7 times, for a total of 6.8 minutes, with the weight of swarf collected in the dust bag after the eighth cycle recorded. The weight of collected swarf is divided by the total cut weight, and this value is defined as dust collection efficiency.

Sanding Test #4

A 5 inch (12.7 centimeters) test disc was attached to 5-hole Hookit V-channel, 5 inch (12.7 centimeter) by 1.25 inch (3.18 centimeters) thick vinyl (hook) faced foam back up pad, commercially available from 3M Company and marketed with the trade designation "3M HOOKIT BACKUP PAD" (Part Number 84226). The back up pad was mounted on a fine finishing dual-action orbital sander under the trade designation "MODEL 21038" from Dynabrade Corporation. A dust collection bag with a five micrometer filter was attached to the sander to collect dust.

The abrasive layer was manually brought into contact with a Sikken Colorbuild primer coated test panel, 18 inches by 30 inches (45.7 centimeter by 76.2 centimeters). The sander was run at 90 pounds per square inch (620.5 kilopascals) air line pressure and a down force of 0.53 pounds per square inch (3.65 kilopascals) for 30 seconds. An angle of 2.5 degrees to the surface of the workpiece was used. The 30 second abrading cycle is repeated another 5 times, for a total of 3.0 minutes, from which the total average cut per sample was determined. The average cut rate is determined from an average of two samples.

Porosity Test

Porosity for the porous attachment interface of the present invention is measured with a Gurley Densitometer Model 4410. The Gurley Densitometer measures the amount of time, in seconds, required for 300 cubic centimeters of air to pass through a 0.65 square centimeter area of the porous attachment interface using a 1.39 Joules/meter force.

The following abbreviations are used in the following Examples.

AI1: A nylon fabric, available under the trade designation "TRICOT" from Sitip Industirl. Busto Arsizio. Italy;

AI2: A nylon fabric, available under the trade designation Millilock from Milliken Company, Spartanburg, S.C.;

AI3: A resin bonded nonwoven polyethylene teraphthalate, 43 grams per square meter, obtained from Stearns Technical Textiles Company, Cincinnati, Ohio;

AI4: An ethyl acrylic acid primed 4 mil. (101.6 micrometer) polyethylene teraphthalate film, obtained from 3M Company;

"BUP1": A 5-hole backup pad, available under the trade designation "3M HOOKIT 051131 84226 BACKUP PAD" from 3M Company;

"BUP2": A 21-hole backup pad, available from KWH Mirka LTD, Jeppo, Finland;

"TP1": A mild steel test panel coated with primer, available under the trade designation "URO1140S" from Dupont Automotive, Inc., Detroit, Mich.;

"TP2": A mild steel test panel coated with primer, available under the trade designation "SIKKENS COLORBUILD BLACK" from Akzo Nobel Coatings, Inc., Norcross, Ga.;

"TP3": A mild steel test panel coated with eCoat (ED6060) Primer (764204), Basecoat (542AB921 black), and Clear coat (RK8148), available from ACT Laboratories, Inc, Hillsdale, Mich.;

"TP4": A panel, available under the trade designation "BUTYRATE BLUE" from Seelye-Eiler Plastics, Bloomington, Minn.;

"TP5": A fiberglass panel coated with a polyester/vinyl ester gel coat provided by White Bear Boat Works, White Bear Lake, Minn.;

"TP6": A panel, available under the trade designation "ACRYLIC PLASTIC" from Seelye-Eiler Plastics.

Sample Preparation

Example 1: A phenolic resin, available under the trade designation "BAKELITE PHENOLIC RESIN" from Bakelite Epoxy Polymer Corporation, Augusta, Ga., was dispersed to 56% solids in a 90:10 by weight water: polysolve medium, then diluted to 35% by weight solids with ethanol. The resin dispersion was applied as a make coat to a fiberglass plain weave scrim, available under the trade designation "1620" from Hexcel Reinforcements, Anderson, S.C. Grade P320 alumina abrasive mineral, obtained under the trade designation "FSX" from Triebacher Schleifmittel AG, Villach, Austria was electrostatically coated onto the resin, cured for 2 hours at 205 degrees Fahrenheit (96 degrees Celsius). A size coat of 35% by weight was then applied over the make coat and minerals, and the coating was cured for 16 hours at 212 degrees Fahrenheit (100 degrees Celsius). A 30% by weight aqueous dispersion of 85:15 by weight zinc stearate:polyacrylate was applied over the size coat.

Example 2: A screen abrasive made according to Example 1, wherein the FSX grade P320 alumina abrasive was replaced with an equivalent quantity of type FSX grade P80 mineral.

Example 3: An adhesive, type "3M 77 SPRAY ADHESIVE" from 3M Company, was lightly sprayed onto the non-abrasive side of Example 1 and to one side of AI1, and the two materials were laminated together.

Example 4: An adhesive, type "3M 77 SPRAY ADHESIVE" from 3M Company, was lightly sprayed onto the non-abrasive side of Example 1 and to one side of AI3, and the two materials were laminated together.

Example 5: An adhesive, type "3M 77 SPRAY ADHESIVE" from 3M Company, was lightly sprayed onto the non-abrasive side of Example 2 and to one side of AI1, and the two materials were laminated together.

Example 6: "3M 77 SPRAY ADHESIVE" was lightly sprayed onto the non-abrasive side of Example 1 and to one side of AI4, and the two materials were laminated together.

Example 7: A phenolic resin, available under the trade designation "BAKELITE PHENOLIC RESIN" from Bakelite Epoxy Polymer Corporation, Augusta, Ga., was dispersed to 56% solids in a 90:10 by weight water: polysolve medium, then diluted to 35% by weight solids with ethanol. The resin dispersion was applied as a make coat to a fiberglass plain weave scrim, available under the trade designation "1620-12" from Hexcel Reinforcements, Anderson, S.C. Grade P400 alumina abrasive mineral, obtained under the trade designation "FSX" from Triebacher Schleifmittel AG, Villach, Austria was electrostatically coated onto the resin, cured for 2 hours at 205 degrees Fahrenheit (96 degrees Celsius). A size coat of 35% by weight was then applied over the make coat and minerals, and the coating was cured for 16 hours at 212 degrees Fahrenheit (100 degrees Celsius). A 30% by weight aqueous dispersion of 85:15 by weight zinc stearate:polyacrylate was applied over the size coat. An adhesive, type "3M 77 SPRAY ADHESIVE" from 3M Company, was lightly sprayed onto the non-abrasive side and to one side of AI1, and the two materials were laminated together.

Comparatives

Comparative A: A grade P320 mesh abrasive having an integral loop attachment backing, available under the trade designation "ABRANET P320" from KWH Mirka LTD, Jeppo, Finland;

Comparative B: A grade P80 mesh abrasive having an integral loop attachment backing, available under the trade designation "ABRANET P80" from KWH Mirka LTD, Jeppo, Finland;

Comparative C: A grade P320 alumina coated abrasive film disc, available under the trade designation "334U P320" from 3M Company;

Comparative D: A grade P80 alumina coated abrasive film disc, available under the trade designation "734U P80" from 3M Company;

Comparative E: A grade P400 mesh abrasive having an integral loop attachment backing, available under the trade designation "ABRANET P400" from KWH Mirka LTD, Jeppo, Finland; and Comparative F: A grade P400 abrasive disc, available under the trade designation "POLINET" from Koyo-Sha Co. LTD, Tokyo, Japan, having abrasive particles that are not erectly oriented.

Porosity tests were performed on various backings and samples using Gurley Densitometer. Results are listed in Table 1.

TABLE 1

| Sample | Porosity Time Required (seconds) for 300 cubic centimeters |
|---|---|
| AI1 | 0.3 |
| AI2 | 0.3 |
| AI3 | 0.3 |
| Comparative A | 0.5 |
| Example 4 | 0.5 |
| Example 3 | 0.5 |
| Comparative C | >120 |

Examples 1, 3 and 6 were evaluated according to Sanding Test #3, using gel coat test panel TP1. Total cut and dust extraction results are listed in Table 2.

TABLE 2

| Sample | Backup Pad | Total Cut (grams) | Dust Collected (grams) | Collection Efficiency (%) |
|---|---|---|---|---|
| Example 1 | No attachment | 17.6 | 11.4 | 64.8 |
| Example 3 | BUP1 | 19.5 | 11.2 | 62.7 |
| Example 6 | BUP1 | 17.6 | 5.1 | 29.6 |

Examples 3, 5, and Comparatives A-D were evaluated for cut life according to the sanding tests and test panels listed in Table 3.

TABLE 3

| Sample | Test Panel | Total Cut (grams) | Sanding Test | Vacuum |
|---|---|---|---|---|
| Comparative A | TP2 | 14.7 | 1 | Not used |
| Comparative C | TP2 | 18.6 | 1 | Not used |
| Example 3 | TP2 | 20.2 | 1 | Not used |
| Comparative B | TP3 | 14.3 | 1 | Not used |
| Comparative D | TP3 | 15.9 | 1 | Not used |
| Example 5 | TP3 | 17.8 | 1 | Not used |
| Comparative B | TP4 | 21.9 | 1 | Not used |
| Comparative D | TP4 | 24.5 | 1 | Not used |
| Example 5 | TP4 | 26.7 | 1 | Not used |
| Comparative A | TP5 | 6.95 | 2 | Self-Generated |
| Example 3 | TP5 | 7.45 | 2 | Self-Generated |
| Comparative A | TP6 | 9.8 | 3 | External |
| Example 3 | TP6 | 14.9 | 3 | External |

Examples 3, 4, and Comparative A, were evaluated according to Sanding Test #3, using gel coat test panel TP5. Results are listed in Table 4.

TABLE 4

| Sample | Backup Pad | Dust Extraction Efficiency (%) |
|---|---|---|
| Comparative A | BUP2 | 94.3 |
| Example 3 | BUP2 | 90.4 |
| Example 4 | BUP2 | 92.7 |

Examples 7, Comparative E, and Comparative F were evaluated according to Sanding Test #4. Results are listed in Table 5.

TABLE 5

| Sample | Average Cut (grams) |
|---|---|
| Example 7 | 13.04 |
| Comparative E | 8.23 |
| Comparative F | 4.55 |

It is to be understood that even in the numerous characteristics and advantages of the present invention set forth in above description and examples, together with details of the structure and function of the invention, the disclosure is illustrative only. Changes can be made to detail, especially in matters of the dimensions and compositions of the screen abrasive and porous attachment interface and methods of use within the principles of the invention to the full extent indicated by the meaning of the terms in which the appended claims are expressed and the equivalents of those structures and methods.

What is claimed is:

1. An abrasive article comprising:

a screen abrasive comprising an open mesh backing having a first major surface having an area, a second major surface, and a plurality of openings extending from said first major surface to said second major surface, and an abrasive layer secured to at least a portion of said first major surface of said backing, said abrasive layer comprising a plurality of erectly oriented abrasive particles and at least one binder; and a porous attachment interface associated with said second major surface of said open mesh backing, said porous attachment interface comprising a loop portion of a two-part mechanical engagement system and cooperating with said screen abrasive to allow the flow of particles through said abrasive article.

2. The abrasive article of claim 1 wherein said open mesh backing is woven.

3. The abrasive article of claim 2 wherein said open mesh backing comprises at least one of fiberglass, nylon, polyester, polypropylene, or aluminum.

4. The abrasive article of claim 1 wherein said open mesh backing is a perforated film.

5. The abrasive article of claim 1 wherein said openings in said open mesh backing have an average open area of at least 0.3 square millimeters.

6. The abrasive article of claim 1 wherein said openings have a total open area of at least 50 percent of the area of said first major surface.

7. The abrasive article of claim 1 wherein said particles comprise particles having a size of at least 10 micrometers.

8. The abrasive article of claim 1 wherein said porous attachment interface comprises a nonwoven.

9. The abrasive article of claim 8 wherein said nonwoven has a Gurley porosity no greater than 3 seconds per 300 cubic centimeters of air.

10. The abrasive article of claim 9 having an abrasive article Gurley porosity no greater than 3 seconds per 300 cubic centimeters of air.

11. The abrasive article of claim 1 further comprising adhesive securing said porous attachment interface to said second major surface of said open mesh backing.

12. The abrasive article of claim 11 wherein said adhesive comprises a hot-melt adhesive.

13. The abrasive article of claim 11 wherein said adhesive comprises a spray adhesive.

14. An abrasive article comprising:

a woven backing having a first major surface, a second major surface, and a plurality of openings extending from said first major surface to said second major surface;

an abrasive layer secured to at least a portion of said first major surface of said backing, said abrasive layer comprising a plurality of erectly oriented abrasive particles and at least one binder; and a porous attachment interface affixed to said second major surface of said backing, said porous attachment interface comprising a loop portion of a two-part mechanical engagement system;

wherein said abrasive article is porous.

15. The abrasive article of claim 14 wherein said porous attachment interface comprises a nonwoven.

16. The abrasive article of claim 14 having an abrasive article Gurley porosity no greater than 3 seconds per 300 cubic centimeters of air.

17. The abrasive article of claim 14 wherein said openings have a total open area of at least 50 percent of the area of said first major surface.

18. A method of making an abrasive article comprising:

providing a screen abrasive comprising an open mesh backing having a first major surface, a second major surface, and a plurality of openings extending from said first major surface to said second major surface, and an abrasive layer affixed to at least a portion of said first major surface of said backing, said abrasive layer comprising a plurality of erectly oriented abrasive particles and at least one binder; and affixing a porous attachment interface to at least a portion of said second major surface of said open mesh backing, said porous attachment interface comprising a loop portion of a two-part mechanical engagement system and cooperating with said screen abrasive to allow the flow of particles through said abrasive article.

19. The method of claim 18 further comprising securing said abrasive layer to said open mesh backing.

20. The method of claim 18 further comprising applying an adhesive onto at least one of said second major surface of said open mesh backing and said porous attachment interface.

* * * * *